US007210614B2

(12) United States Patent
Mazurek

(10) Patent No.: US 7,210,614 B2
(45) Date of Patent: May 1, 2007

(54) GIFT BOX CONTAINER

(75) Inventor: Richard Mazurek, Huntingdon Valley, PA (US)

(73) Assignee: Meadwestvaco Corporation, Glen Allen, VA (US)

( * ) Notice: Subject to any disclaimer, the term of this patent is extended or adjusted under 35 U.S.C. 154(b) by 92 days.

(21) Appl. No.: 10/697,126

(22) Filed: Oct. 31, 2003

(65) Prior Publication Data

US 2005/0092821 A1 May 5, 2005

(51) Int. Cl.
*B65D 5/24* (2006.01)
*B65D 5/56* (2006.01)

(52) U.S. Cl. ..... 229/122.34; 229/122.32; 229/182; 229/186

(58) Field of Classification Search ..... 229/122.32, 229/122.34, 125.19, 182, 186, 923; 493/95, 493/98, 100, 114
See application file for complete search history.

(56) References Cited

U.S. PATENT DOCUMENTS 502,952 A 8/1893 Craw
670,612 A * 3/1901 Houghland ..... 229/122.34
959,261 A * 5/1910 Reber ..... 229/122.34
1,046,945 A * 12/1912 Bauer et al. ..... 229/186
1,081,068 A 12/1913 Vance
1,698,699 A 6/1929 Andrews
1,793,025 A 2/1931 Spitzenberger
1,833,492 A * 11/1931 Miller ..... 229/186
1,906,622 A * 5/1933 Kondolf ..... 229/122.34
2,084,965 A * 6/1937 Wolf ..... 229/182
2,495,807 A * 1/1950 Buttery ..... 229/171
2,944,719 A 7/1960 Arneson
3,136,473 A * 6/1964 Kieffer ..... 229/166
3,941,305 A 3/1976 Chipp et al.
4,380,314 A * 4/1983 Langston et al. ..... 229/182
4,802,619 A * 2/1989 Laido ..... 229/125.19
6,478,217 B1 11/2002 Lombardi et al.

* cited by examiner

*Primary Examiner*—Gary E. Elkins

(57) ABSTRACT

Stiffened double walled gift boxes are formed from paperboard blanks having main panels and wall panels with inner halves connected by gussets. A stiffener with a central panel and hinged sides half as wide as the side panels is placed in the main panel. Adhesive is applied on inner surfaces of the outer panels. As the wall panels are folded along peripheral edges of the main panel the loose stiffener is aligned by the wall panels. Sides of the stiffener bend with side panels of the box. Gussets are folded and placed inside end walls and are secured by outer end panels secured to inner end panels. Outer side panels are folded inward and adhered on sides of the stiffener, locking the stiffener in place.

9 Claims, 3 Drawing Sheets

GIFT BOX CONTAINER

BACKGROUND OF THE INVENTION

Double walled gift boxes are well known. Covers and base boxes are usually formed from relatively flexible paperboard blanks having decorative outer surfaces and flat clean inner surfaces. Side and end walls are folded inward upon themselves to form double walls adhered together by adhesives. Inner portions of the walls are connected by creased gussets, which are folded and tucked into junctions of the end and side walls. Glue strips connect inner and outer portions of the walls. Folded gussets are held in place by the glue strips. Cutting, folding and gluing equipment is widely available for forming the single blank double wall boxes.

Reinforcement of the double walled boxes with heavier sheets is sometimes useful. When large heavier sheets are added to boxes gluing and alignment of the sheets to which adhesive has been applied becomes a problem.

Needs exist for improved boxes and methods of construction, which reduce defects while simplifying equipment and processes.

SUMMARY OF THE INVENTION

The new gift box container has a paperboard rectangular box base with a similar separate cover. A cover or base may have a reinforced insert. A reinforced cover could be used without a reinforced base or a reinforced base could be used with a cover or simple over wrap.

The box base and cover are each formed as trays folded from a sheet of paperboard. Each sheet has inner and outer surfaces, a main panel and four flanking panels, one on each edge of the main panel for forming ends and sides. The main panel of the cover is slightly larger than the main panel of the base. The flanking panels on the cover are approximately one half the width of the flanking panels on the box portion. In consequence, the walls of the cover are about a short way, half the height of the walls of the base. The walls of the cover on the assembled box extend about halfway or completely down the walls of the base in the assembled and closed configuration.

During or after cutting, the sheets are creased where the four flanking panels join the main panel. The flanking panels are creased at their midlines to form inner and outer halves of side and end panels. The outer halves later are folded inside the inner halves to form double thickness walled trays useful as the cover and box base portions.

Webs or gussets connect the inner halves of the sides and ends. The webs are creased and partially lanced diagonally for folding and tucking into the ends when the sides and ends are folded upward.

A heavier stiffening sheet of paperboard equal in size to the main panel and ⅛" to ¼" shorter than the width of each of the two flanking side panels is inserted in each tray prior to the inward folding of the flanking panels. This heavier sheet is creased, for example, by perforations, bar scores or 50% cut scores to delineate and form the joint between the sides and the central panel of the stiffening sheet. The stiffening sheets grain may be perpendicular, parallel or at an angle to the grain of the paperboard sheet that forms the walled tray. Parallel adhesive strips are laid on the upper faces of the outer halves of the side and end panels of the box base or cover tray. The stiffening sheet is placed on the inner face of the main panel of the cover or base. The side and end panels of the tray are folded perpendicularly to the inner face of the main panel, which also folds the side panels of the stiffening sheet perpendicular to the inner face of the central panel. The stiffening sheet may have creased ends similar to its sides to fit into and adhere similarly to end panels of the tray forming sheet.

The outer halves of the end panels are folded inward along the midline creases and are adhered to the inner halves of the end panels. The outer halves of the side panels are folded inward at their midline creases and are adhered to the inner faces of the sides of the heavier stiffening sheet locking it in place. The stiffener sides are held between the inner and outer halves of the side panels. The central panel of the stiffener is held aligned with but not glued to the main panel of the tray.

During the folding operations, the creased gussets are folded along their creases and are tucked inward along ends of inner faces of the inner halves of the end panels. When the outer halves with the pre-applied adhesive strips are folded inward, the adhesive strips contact the folded gussets as well as the inner faces of inner halves of the end panels, fixing the gussets in their tucked positions.

Adhesive holds the inward folded side panels to the inward faces of the inward folded side portions of the heavier sheet. Adhesive is not applied between the central panel of the heavier sheet and the main panel of the tray. In one form, inward folded outer end panels are adhered to folded ends of the stiffener sheet. In an alternative form, adhesive may be applied to between the central panel and the main panel.

These and further and other objects and features of the invention are apparent in the disclosure, which includes the above and ongoing written specification, with the claims and the drawings.

DETAILED DESCRIPTION OF THE PREFERRED EMBODIMENTS

Figure 5:
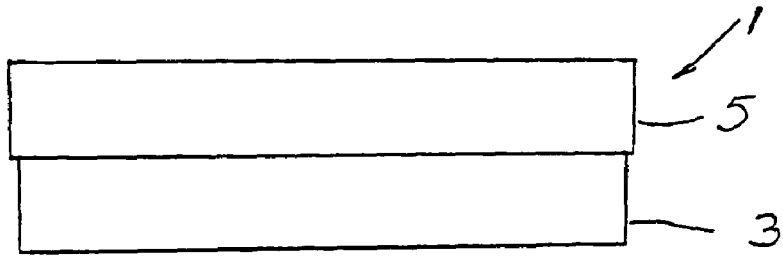
FIG. 5 is an assembled view of the gift box container.

Referring to the drawings, as shown in FIG. 5, the new gift box container 1 has a paperboard rectangular base box 3 with a similar separate cover 5.

Figures 1, 2:
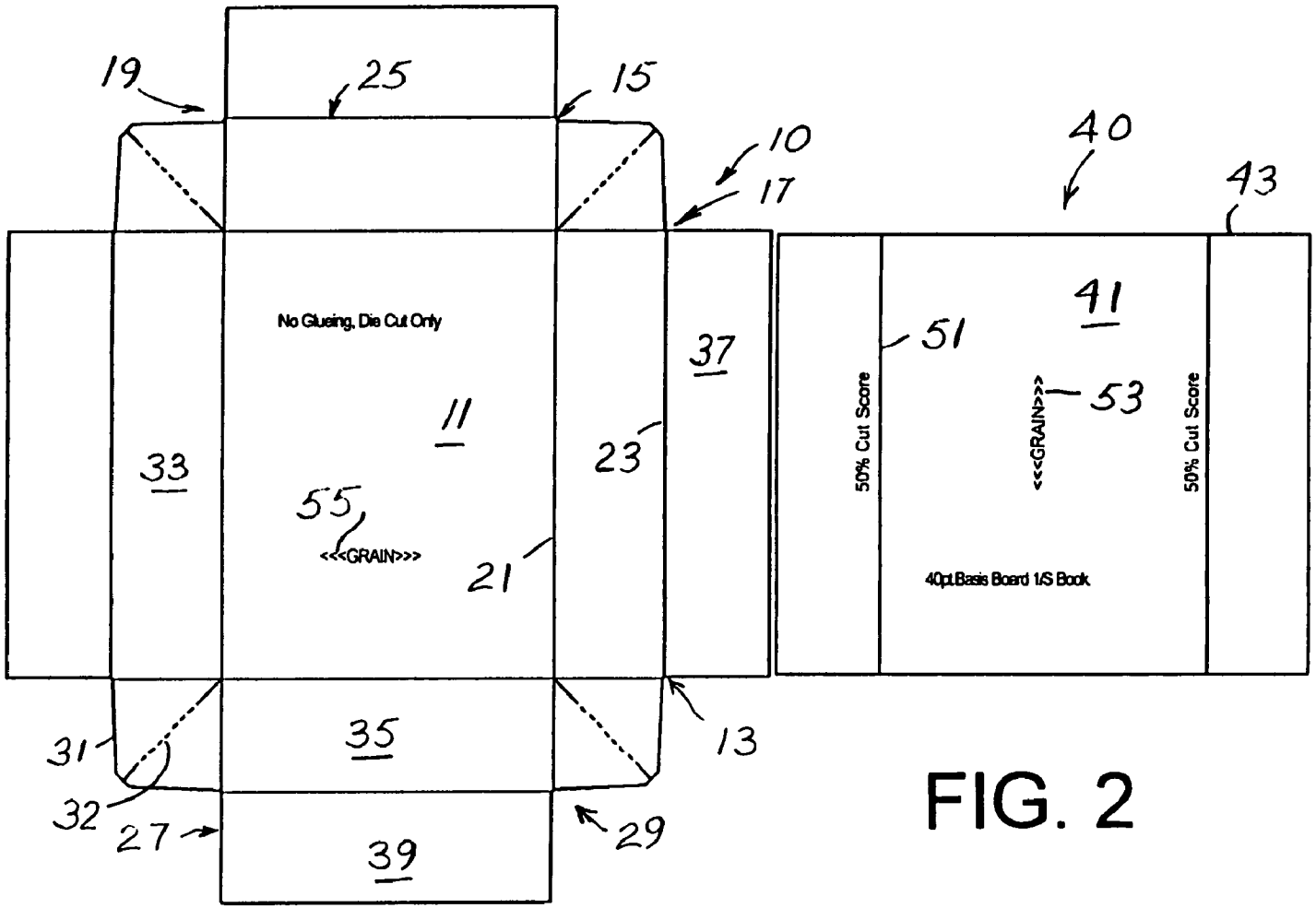
FIG. 1 is a plan view of a tray blank for forming box base or cover as cut and creased.
FIG. 2 is a plan view of a stiffener for a box base or cover as it is cut and scored.
Figure 3:
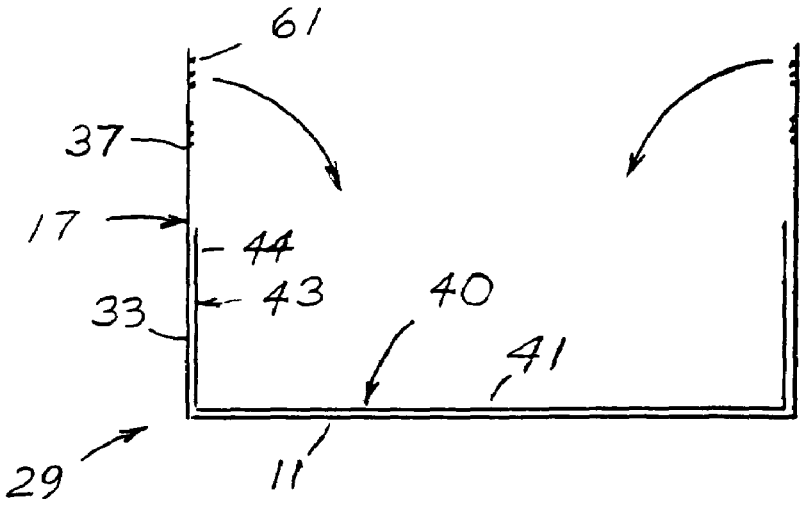
FIG. 3 is a partially assembled cross-section of the box or cover.
Figure 4:
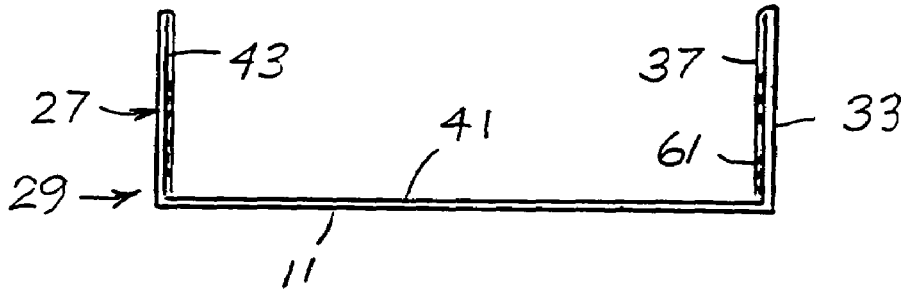
FIG. 4 is a cross-sectional assembled view of the box base or cover.

As shown in FIG. 1, the base box and cover are each folded from a sheet of paperboard 10. Each sheet has inner and outer surfaces, a main panel 11 and four flanking panels 13, 15, one on each edge of the main panel 11 for forming ends 19 and sides 17. The flanking panels 13, 15 on the cover 5 are approximately one half the width of the flanking panels on the box base. In consequence, on the assembled box, the cover extends a short way, about halfway or completely down the sides of the box base. The four flanking panels 13, 15 are creased 21 and folded along the main panel 11 and creased 23 and refolded at their midlines 25 to form double thickness walls 27 on trays 29 useful as the cover 5 and box 3 portions.

Webs or gussets 31 are diagonally creased 32 and partially lanced and connect the inner halves 33, 35 of the sides 17 and ends 19. The gussets 31 are folded and tucked along the walls of the ends 19 when the sides 17 and ends 19 are folded upward.

A heavier sheet of paperboard 40 as shown in FIG. 2 is equal in size to the main panel 11 plus one half the width of each of the two flanking tray side panels 13. This heavier sheet 40 is 50% cut scored 51 to form a central panel 41 and attached sides 43. The central panel 41 is about the size of the main panel 11 of the tray bottom. Its grain 53 runs perpendicular to the grain 55 of the tray paperboard 10 in a preferred embodiment. Grain 53 may be parallel or at angles. The stiffener sheet 41 is inserted on the tray prior to the perpendicular folding of the flanking panels 13, 15. The side and end panels 13, 15 are folded perpendicular to the main panel 11, which folds the sides 43 of the stiffener 40 and aligns the stiffener central panel 41 precisely between the side and end panels 13, 15 along the main panel 11.

The outer halves 37, 39 of the sides and ends are folded inward over the inner halves 33, 35 of the sides 17 and ends 19 after applying adhesive in parallel strips 61 to the inward-facing surfaces of the outer halves 37, 39.

Following the insertion, the outer halves 37 of the side panels 17 are folded over the sides 43 of the heavier sheet 40, locking it in place. Adhesive 61 holds the inward folded outer halves 37 of side panels 17 to the inward faces 44 of the inward folded side portions 43 of the heavier sheet and the inward folded outer halves 39 of the end panels 19 to the inward faces of the inner end panels 35 and to the gussets 31 tucked between them. Adhesive is not applied between the central panel 41 of the heavier sheet and the main panel 11 of the tray 29.

Alternatively inner faces of the outer side panels 37 may be coated with adhesive and folded over the stiffener sides before the gussets are folded and tucked inward along inner surfaces of the inner end panels 35 while the end panels 19 are folded upward. The outer end panels with applied adhesives are folded over the inner end panels and the gussets.

Figure 6:
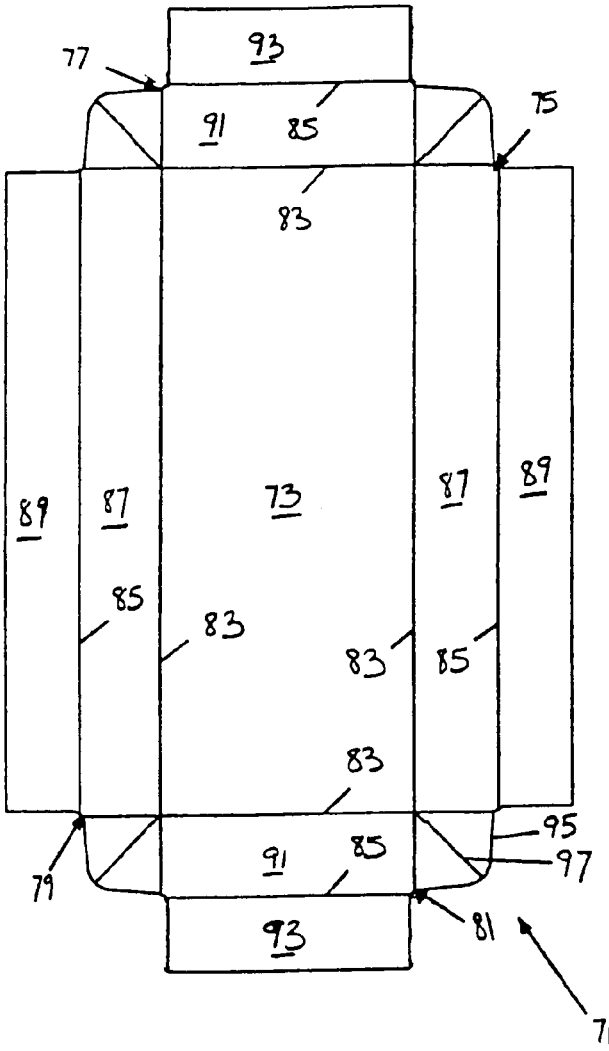
FIG. 6 is a plan view of an alternative tray blank for forming a box base or cover as cut and creased.

As shown in FIG. 6. an alternative base box and cover are each folded from a sheet of paperboard 71. Each sheet 71 has inner and outer surfaces, a main panel 73 and four flanking panels 75, 77, 79, 81, one on each edge of the main panel 73 for forming ends and sides. The flanking panels on the cover are approximately one half the width of the flanking panels on the box base. In consecluence, on the assembled box, the cover extends a short way, about halfway or completely down the sides of the box base. The four flanking panels 75, 77, 79, 81 are creased 83 and folded along the main panel 73 and creased 85 and refolded at their midlines to form double thickness wall side panels and end panels. Each side flanking panel 75, 79 is split into an inner side panel 87 and an outer side panel 89. Each end flanking panel 77, 81 is split into an inner end panel 91 and an outer end panel 93.

Webs or gussets 95 are diagonally creased 97 and partially lanced and connect the inner side panels 87 and inner end panels 91. The gussets 95 are folded and tucked along the walls of the end panels 77, 81 when the side panels 75, 79 and end panels 77, 81 are folded upward.

Figure 7:
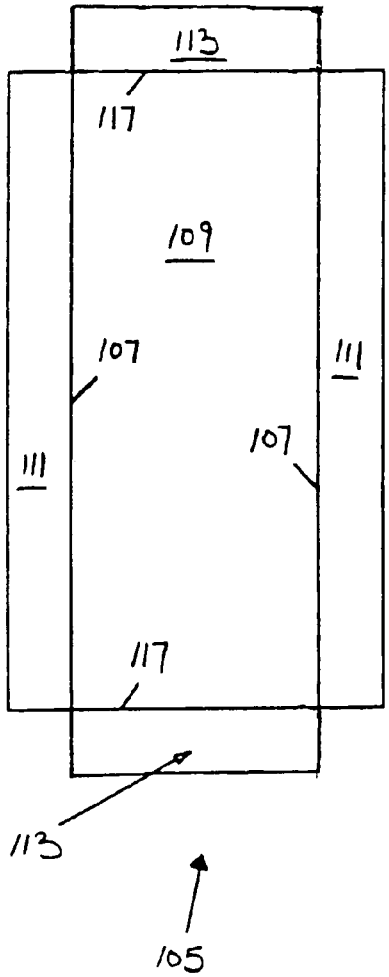
FIG. 7 is a plan view of an alternative stiffening sheet for a box base or cover as it is cut and scored.

An alternative heavier sheet of paperboard 105, as shown in FIG. 7, is equal in size to the main panel 73 plus one half the width of each of the two flanking tray side panels 75, 79, This heavier sheet 105 is scored 107 to form a central panel 109 and attached sides 111. The central panel 109 is approximately the same size as the main panel 73 of the sheet 71 shown in FIG. 6. Ends 113 are also provided if stiffener is required on four sides instead of along two creases 117. The stiffener sheet 105 is inserted on the tray forming sheet 71 prior to the perpendicular folding of the flanking side 75, 79 and end panels 77, 81. The side and end panels are folded perpendicular to the main panel 73, which causes the sides 111 and ends 113 of the stiffener to fold and aligns the central panel 109 of the stiffener between the side panels 75, 79 and end panels 77, 81 along the main panel 73.

The entire box may be formed with conventional cutting, adhesive laying, and folding equipment. The stiffening sheet is cut and scored in a single operation and is placed in a single step. The initial perpendicular folding of the ends and sides insures precise alignment of the stiffener. No special provision is required for the precise aligning of detached parts when they are juxtaposed or are glued in place. No separate requirements for special aligning, placing, and bonding steps are present.

The bending of the sides along scores in the stiffening sheet automatically aligns and precisely positions the central panel of the stiffening sheet with respect to the main panel of the tray sheet as the side and end panels of the tray sheet are bent upward. The stiffening sheet is automatically locked in position by the inward folding and gluing of the outer side panel halves which would otherwise contact the inner surfaces of the inner side panel halves of a double walled box tray.

Savings result from no increases in steps to handle the outer sheet when forming a double walled tray and no requirements to spread adhesive over the large main panel of the tray-forming sheet. Further increased savings result from not requiring precision placement equipment for aligning two large panels after gluing. The invention has the added advantage of reducing rejects from misaligned glued panels. Speed of production may be increased by the elimination of need for precise alignment before adhering large panels. Additional savings result from reduction of adhesive requirements, elimination of added adhesive requirements, and elimination of precision aligning and positioning equipment. The look and feel of the finished box may be enhanced by not requiring adhesive under the main panels.

While the invention has been described with reference to specific embodiments, modifications and variations of the invention may be constructed without departing from the scope of the invention, which is defined in the following claims.

I claim:

1. A double-walled gift box apparatus comprising a base box and cover each formed as a double-walled tray, at least one tray having walls and a stiffening sheet secured thereto, said at least one tray being formed from a tray forming sheet comprising a main panel with peripheral edges, said tray forming sheet further comprising side panels and end panels extending from said peripheral edges of the main panel for forming the walls of said at least one tray, wherein said stiffening sheet comprises a central panel and sides connected to the central panel, the central panel being positioned in contact and aligned with the main panel of the tray forming sheet, the sides of the stiffening sheet being in contact and aligned with the side panels of the tray forming sheet, and wherein the side panels and end panels of the tray forming sheet have folds spaced from and parallel to the peripheral edges of the main panel, said folds forming inner side panels and outer side panels and inner end panels and outer end panels, the outer end panels being folded and adhered to the inner end panels in position, and the outer side panels being folded over and adhered to the sides of the stiffening sheet for securing the stiffening sheet to said at least one tray, and said apparatus further comprises creased gussets connecting the inner side panels and the inner end panels of said tray forming sheet, wherein said gussets, when folded, are tucked into spaces between the outer and inner end panels of said tray forming sheet;

wherein said creased gussets are locked in place by adhesive applied to inward facing surfaces of the outer end panels, and wherein the outer side and outer end panels have strips of adhesive applied to inner surfaces thereof prior to folding the outer end panels on the inner end panels, the strips of adhesive on the inner surfaces of the outer side panels contacting and adhering to inner surfaces of the sides of the stiffening sheet.

2. The apparatus of claim 1, wherein the stiffening sheet further has ends hinged to the central panel and wherein the outer end panels of said tray forming sheet are folded over and adhered to the ends of the stiffening sheet.

3. The apparatus of claim 1, wherein both the cover and base box have stiffening sheets.

4. The apparatus of claim 1, wherein each of the base box and cover are formed as a double-walled tray having walls and a stiffening sheet secured thereto, wherein the tray is formed from a tray forming sheet comprising a main panel with peripheral edges and further comprising side panels and end panels extending from the peripheral edges of the main panel for forming the walls of the tray, and wherein the side and end panels of the base and cover are equal in length, forming a square box.

5. The apparatus of claim 1, wherein each of the base box and cover are formed as a double-walled tray having walls and a stiffening sheet secured thereto, wherein the tray is formed from a tray forming sheet comprising a main panel with peripheral edges and further comprising side panels and end panels extending from the peripheral edges of the main panel for forming the walls of the tray, and wherein the main, side and end panels of the base and cover form a rectangular box.

6. A double-walled gift box apparatus comprising a base box formed as a double-walled tray, the tray having walls and a stiffening sheet secured to the tray, the tray being formed from a tray forming sheet having a main panel with peripheral edges and having side panels and end panels extending from the peripheral edges of the main panel for forming the walls of the tray, the stiffening sheet having a central panel and sides connected to the central panel, the central panel being positioned in contact and aligned with the main panel of the tray forming sheet, the sides of the stiffening sheet being in contact and aligned with the side panels of the tray forming sheet, the side panels and end panels of the tray forming sheet having folds spaced from and parallel to the peripheral edges of the main panel, said folds forming inner side panels and outer side panels and inner end panels and outer end panels, the outer end panels being folded inward and adhered to the inner end panels, and the outer side panels being folded over and adhered to the sides of the stiffening sheet for securing the stiffening sheet to the tray, the apparatus further comprising creased gussets connecting the inner side panels and inner end panels of the tray forming sheet, wherein said gussets, when folded, are tucked into spaces between the outer and inner end panels of the tray forming sheet, wherein said creased gussets are locked in place by adhesive applied to inward facing surfaces of the outer end panels, and wherein the outer side and outer end panels have strips of adhesive applied to inner surfaces thereof prior to folding the outer end panels on the inner end panels, the strips of adhesive on the inner surfaces of the outer side panels contacting and adhering to inner surfaces of the sides of the stiffening sheet.

7. The apparatus of claim 6, wherein the stiffening sheet further has ends hinged to the main panel and wherein the outer end panels of the tray forming sheet are folded over and adhered to inner surfaces of the ends of the stiffening sheet.

8. The apparatus of claim 6, wherein the side and end panels of the tray forming sheet are equal in length, forming a square box.

9. The apparatus of claim 6, wherein the main, side and end panels of the tray forming sheet form a rectangular box.

* * * * *